United States Patent [19]

Kuda et al.

[11] 4,190,067

[45] Feb. 26, 1980

[54] METHOD AND APPARATUS FOR INSERTION OF WEFT THREADS IN JET WEAVING MACHINES

[75] Inventors: Vladimir Kuda, Brno; Vladimir Vasicek, Moravsky Krumlov; Borivoj Suchanek, Brno, all of Czechoslovakia

[73] Assignee: Vyzkumny a vyvojovy ustav Zavodu vseobecneho strojirenstvi, Brno, Czechoslovakia

[21] Appl. No.: 829,153

[22] Filed: Aug. 30, 1977

Related U.S. Application Data

[63] Continuation-in-part of Ser. No. 726,575, Sep. 27, 1976, abandoned.

[30] Foreign Application Priority Data

Sep. 27, 1975 [CS] Czechoslovakia ..... 6543-75

[51] Int. Cl.[2] ..... D03D 47/30

[52] U.S. Cl. ..... 139/435

[58] Field of Search ..... 139/435, 188; 226/95

[56] References Cited

U.S. PATENT DOCUMENTS

| | | | |
|---|---|---|---|
| 3,139,118 | 6/1964 | Svaty et al. | 139/435 |
| 3,847,187 | 11/1974 | Buran et al. | 139/435 |

*Primary Examiner*—Henry Jaudon

[57] ABSTRACT

A method and arrangement for picking a weft thread by means of a weft thread inserting comb in a jet loom. The comb is composed of a plurality of juxtaposed comb members which are mounted on a reciprocating slay of the jet loom. Each comb member has a pair of shank portions which define a weft inserting opening and an unthreading channel. The comb members, when in their operative positions, define a weft inserting channel. At least one of the comb members has secondary carrying fluid conduit means which directs via an outlet a stream of a secondary carrying fluid into a zone of said weft inserting channel which is disposed below the axis of the channel relative to the unthreading channels of the comb.

6 Claims, 15 Drawing Figures

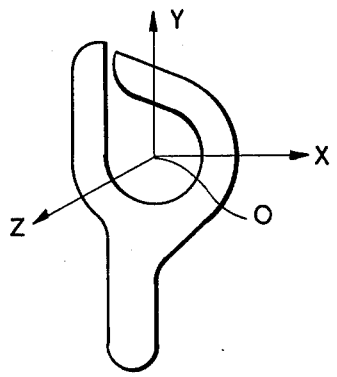
FIG. 9
FIG. 9F
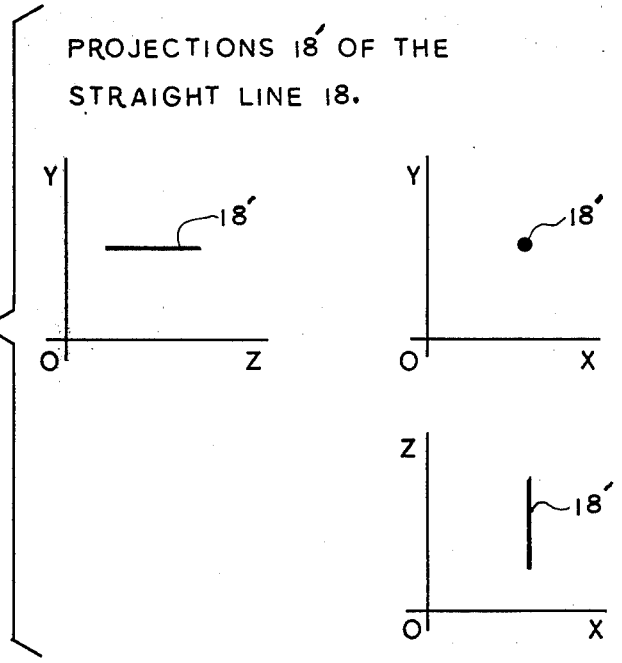

THE 12', 15', AND 18' OF THE AXES 12, 15, AND 18, RESPECTIVELY RIGHT ANGLE PROJECTIONS.

PROJECTIONS 12′ OF THE AXIS 12 OF THE WEFT INSERTING COMB.

PROJECTIONS 15′ OF THE AXIS 15 OF THE ADDITIVE BLASTING OUTLET CONDUIT.

METHOD AND APPARATUS FOR INSERTION OF WEFT THREADS IN JET WEAVING MACHINES

This application is a continuation-in-part of application Ser. No. 726,575, filed Sept. 27, 1976, now abandoned.

BACKGROUND OF THE INVENTION

The present invention relates to a method of inserting weft threads through the shed of a loom by means of a stream of a fluid medium passing through a guide comb in jet weaving machines and the guide comb for performing this method.

In known jet weaving machines, the weft yarn or thread is inserted through the shed by means of an entraining fluid medium flow formed by a suitably arranged nozzle. The fluid medium flow entraining the weft yarn to be inserted is guided and directed by the guide comb, the members of which are turned at the moment of weft inserting via the lower warp thread system into the shed. Each member of the comb is provided with a weft inserting opening and has a guide profile and an unthreading gap.

The disadvantage of this so-called impulsive weft insertion arrangement resides in that, with an increasing width of the weaving machine, the range of the fluid entraining medium flow is inadequate which causes a weft insertion of inferior quality at more distant points from the nozzle. Consequently, this method of weft insertion is suitable only for weaving machines of narrow and medium widths.

There are, furthermore, known various embodiments of active weft yarn insertion methods and apparatus in which there are interposed between the members having so-called passive openings active members having active outlet conduits through which an additive fluid carrying medium is conducted, and by means of which the fluid carrying medium flow is accelerated. Among these are the arrangements shown in the U.S. Pat. Nos. to Svaty et al, 3,139,118, and Buran et al, 3,847,187. However, it has been observed that the additive fluid carrying medium in the arrangements of the prior art causes the weft yarn which is being inserted to be influenced in a negative manner by the fluid additive weft inserting medium. For example, the weft yarn frequently oscillates across the whole cross section of the weft inserting openings of the comb members. These oscillations may cause the weft yarn to enter the unthreading gap, whereby frequently weft defects are caused.

To prevent the escape of the weft thread through the unthreading gaps of the weft insertion comb members mechanical means for closing this gap have been used, e.g. a resilient diaphragm. However, such an arrangement is applicable to a limited extent only, particularly when fine weft yarns are used, or it has a very complicated construction.

SUMMARY OF THE INVENTION

It is a general object of this invention to provide a weft yarn or thread insertion method in which the above mentioned disadvantages and shortcomings are eliminated or at least mitigated. In the weft inserting method through a weft inserting comb according to the present invention the front part of the inserted weft yarn is directed, in particular upon its motion through the weft inserting openings of the comb members, by a secondary fluid carrying medium which flows through the comb into the zone of the weft insertion openings and the inlet openings of which are situated opposite the unthreading gaps in the members of the comb.

The weft inserting comb according to the present invention, is formed by a system of flat members which are provided with weft inserting openings having unthreading gaps. The members of the comb system have at least one active comb member. One of the essential characteristic features of this weft insertion comb resides in that each active comb member of the weft inserting comb is provided at least on a part of its circumference defining the weft inserting opening in the zone adjacent to its unthreading gap, with at least one outlet conduit for an additive fluid carrying medium, the axis of which when rectangularly projected onto a plane, which is determined (defined) by the axis of the weft inserting comb and a straight line connecting the midpoints of the ends of the unthreading channels of the weft inserting comb, makes an angle with the axis of the weft inserting comb falling in the range from 5° to 30°, preferably 15°.

Another feature of the weft inserting apertured comb according to the present invention resides in that at least one of its active comb members is provided with additive blasting segments outlet conduits the axes of which intersect each other in the space disposed below a plane parallel to the axis of the weft inserting comb and intersecting the axes of a pair of appurtenant additive blasting outlet conduits which are most distantly spaced from the unthreading gaps or channels of the comb.

A still further feature of the weft inserting apertured comb, according to the present invention, resides in that at least one of its active comb members is provided with additive blasting outlet conduits, the axes of which intersect each other in the space situated below a plane parallel to the axis of the weft inserting comb and including the connecting line between two additive blasting outlet conduits situated most remote from the inner end of its unthreading gap considered in a direction leading away from the unthreading gaps of the comb.

Another feature of the weft inserting apertured comb, according to the present invention, resides in that the axes of the additive blasting outlet conduits of at least one active member of the weft inserting comb mutually intersect each other in one plane which is defined by the axis of the comb and a straight line of passing through the midpoints at the inner ends of the unthreading gaps of the comb.

In accordance with preferred embodiments of the invention, the additive blasting outlet conduits are located only in the arms of the tooth close to but always beside the exit slot. None of the outlets is directed against the exit slot. This new arrangement ensures a stable and balanced flight of the weft thread through the inserting comb making the weft occupy, in the course of insertion, such a position which does not allow its penetration neither into the exit slot nor into the gap between the teeth.

The basic advantage of the method and arrangement of the present invention resides in that the secondary flow of the carrying fluid medium is accelerated and directed reliably toward the weft yarn. The velocity of weft insertion is therefore more uniform and the negative influence of the unthreading gaps of the weft inserting comb are being minimized.

BRIEF DESCRIPTION OF THE DRAWING

The invention is further set forth in the following detailed description taken in conjunction with the appended drawing, in which:

FIG. 9 is a diagram showing a three-plane system of coordinates superimposed upon a comb in accordance with the invention shown in end elevation;

FIG. 9*f* is a three-part composite view showing the projections 18' of the straight line 18 through the midpoints of the weft inserting openings of the comb upon the respective planes of FIGS. 9*a*, 9*b* and 9*c*.

DETAILED DESCRIPTION

Figure 1:
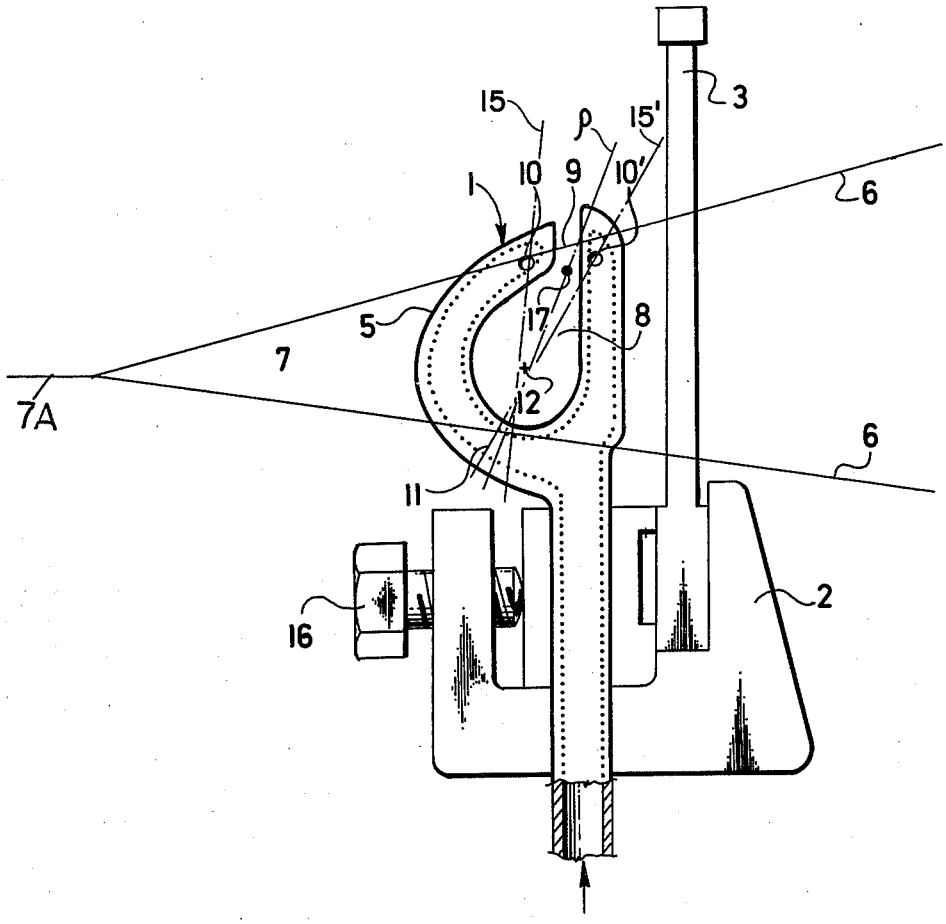
FIG. 1 is a partial cross-sectional view through the weft inserting comb of the invention.

A horizontal weft inserting apertured comb 1, is mounted together with its beat-up reed 3, by means of screw 16 on a known slay 2 of the weaving machine. The device performs the usual reciprocating swinging motion between a weft inserting position, in which the comb members 4 and 5 are shifted along the warp threads 6 into the shed 7, and a beat-up position, in which the members 4 and 5 are shifted outside the shed 7 formed by the warp threads 6. The weft inserting nozzle 13 directs a stream of fluid entraining medium forwardly along the axis 12 of the weft inserting comb 1 in the direction of the arrow in FIG. 1 at least when the comb 1 is in the weft inserting position.

Figure 2:
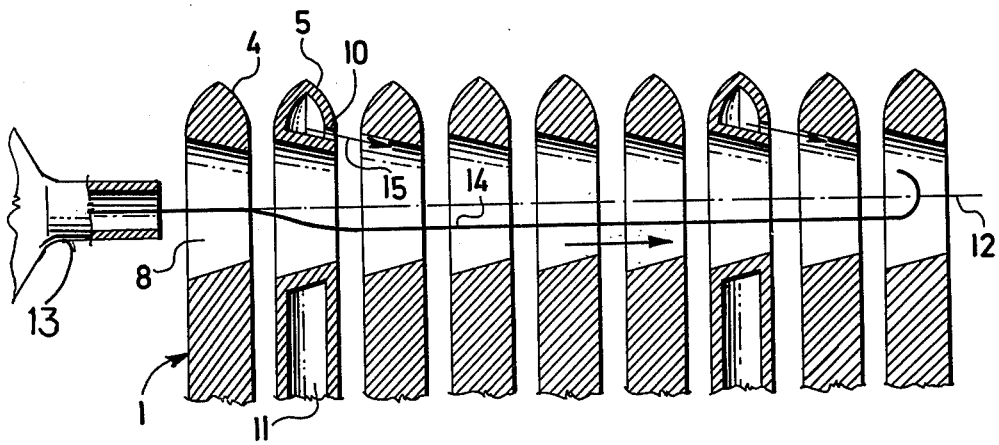
FIG. 2 is a longitudinal sectional view through the weft inserting comb of FIG. 1.

The weft inserting comb 1 is formed by a system of vertical comb members 4, 5, which are provided with weft inserting openings 8. The members 4,5 have a guide profile for directing the stream of fluid medium and unthreading gaps 9, as shown in FIGS. 1 and 2. The weft inserting comb 1 is composed of a plurality of passive members 4 and of at least one active member 5. The latter are distinguished from the former in that they are provided with additive blasting outlets 10 for an additional guided flow of a secondary entraining medium from a distributing conduit 11, which is fed in a controlled manner from a not shown source.

Figure 3:
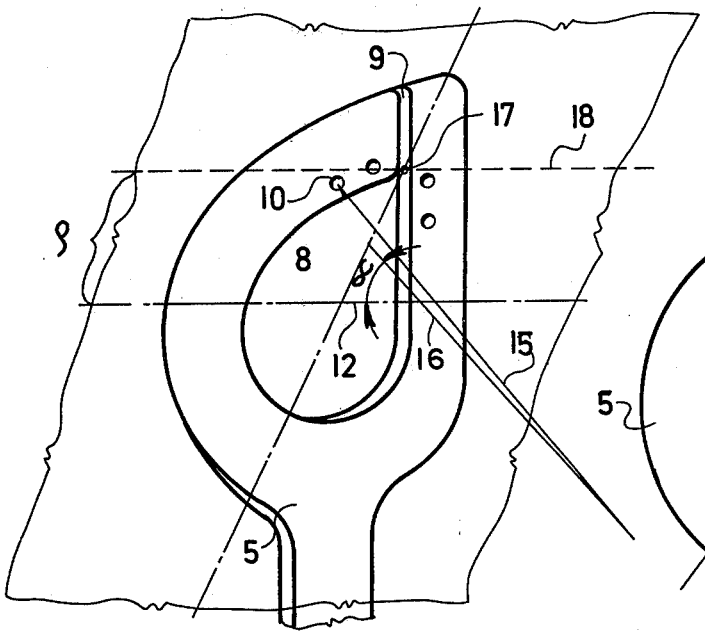
FIG. 3 is a view in perspective showing an active member of the weft inserting comb with the geometrical arrangement of the additive blasting outlets.

The method of weft yarn insertion according to the present invention uses the additive blasting outlets 10 in a special arrangement. One or more outlets 10 are disposed in the zone of the unthreading passage 9 of the active member 5. The active member 5 of FIG. 1 is provided with two additive blasting outlets 10, 10', although the arrangement could operate satisfactorily with only one of outlets 10, 10'. In FIG. 3, the basic geometrical arrangement of each additive blasting outlet 10 is illustrated.

Figure 4:
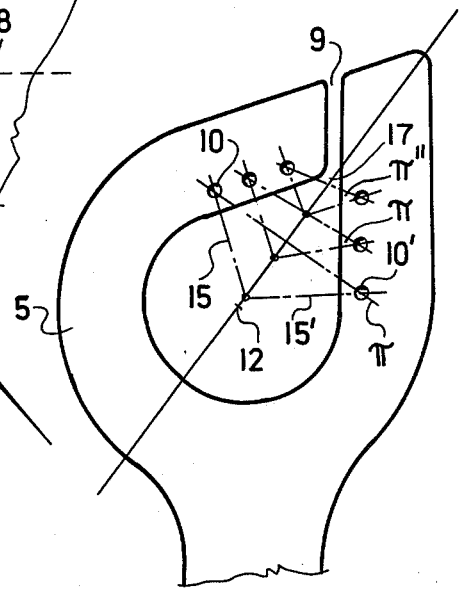
FIGS. 4, 5, 6 and 7 are side views of alternative embodiments of active members of weft inserting combs in accordance with this invention.

The axis passing through the geometric center of the openings 8 of the aligned members 4, 5 of the comb is designated with the reference number 12 and is best shown in FIG. 2. A second imaginary axis parallel to axis 12 passes through the midpoints 17 of the unthreaded passages 9 at their inner ends and is designated with the reference numeral 18. A plane $\rho$ contains, or is defined by, this axis 12 of the weft inserting comb and by the axis 18. The axes passing through the outlet conduits 10 (see FIG. 2) are designated with reference numerals 15. The rectangular projection 16 of the axis 15 on the plane $\rho$ makes an angle $\alpha$ with the axis 12. The rectangular projection 16 is determined by the rectangular projection of the axis 15 on the plane $\rho$. The plane of this projection contains the axis 15 and is perpendicular to the plane $\rho$. This angle may vary from 5° to 30° and is preferably 15°. In FIG. 4, this geometry is illustrated by three pairs of additive blasting outlet conduits 10, 10'. The plane $\pi$ which is defined by a connecting line between the center of the outlets of two opposite additive blasting conduits 10, 10' is parallel to the axis 12 of the inserting comb. The planes $\pi$, $\pi'$, $\pi''$, shown in FIG. 4, pass through the connecting lines of the centers of the outlets of respective pairs of blasting conduits 10, 10', and are seen as lines only being parallel to the axis 12.

Figure 5:
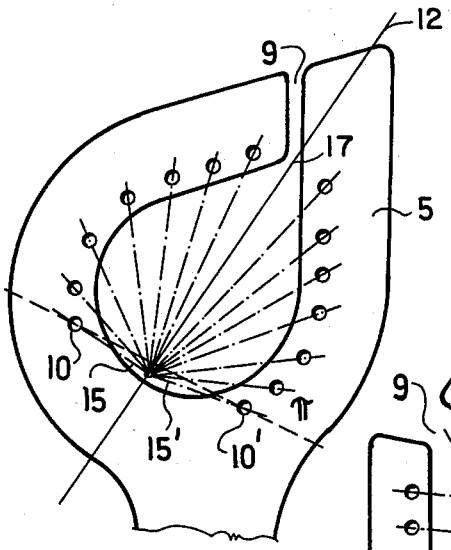

In another advantageous alternative exemplary embodiment of the present invention, illustrated in FIG. 5, all of the axes 15, 15' of the additive blasting outlet conduits 10, 10' mutually intersect each other in the space below plane $\pi$ which is parallel to axis 12 of the weft inserting comb 1 and which passes through the centers of the two additive blasting outlet conduits 10, 10' which are most distant from the unthreading channel 9 of weft insertion orifice comb 1. As can be noted from FIGS. 4 and 5, the exemplary embodiments illustrated therein have the points of intersection of the axes 15, 15' of additive blasting outlet conduits 10, 10' of the active comb members 5 of the weft insertion comb 1 fall into one plane.

Figure 6:
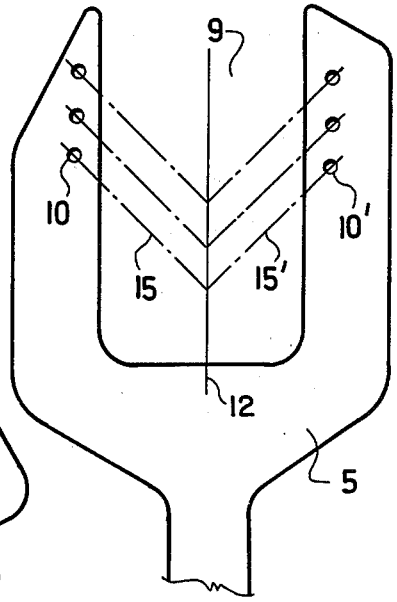
Figure 7:
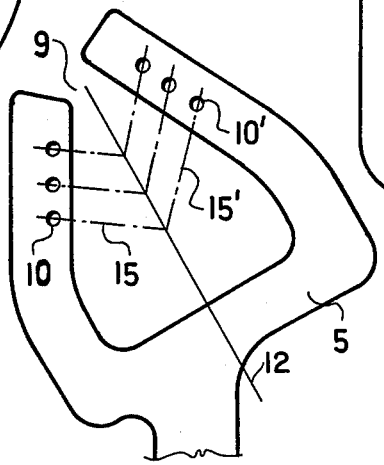
Figure 8:
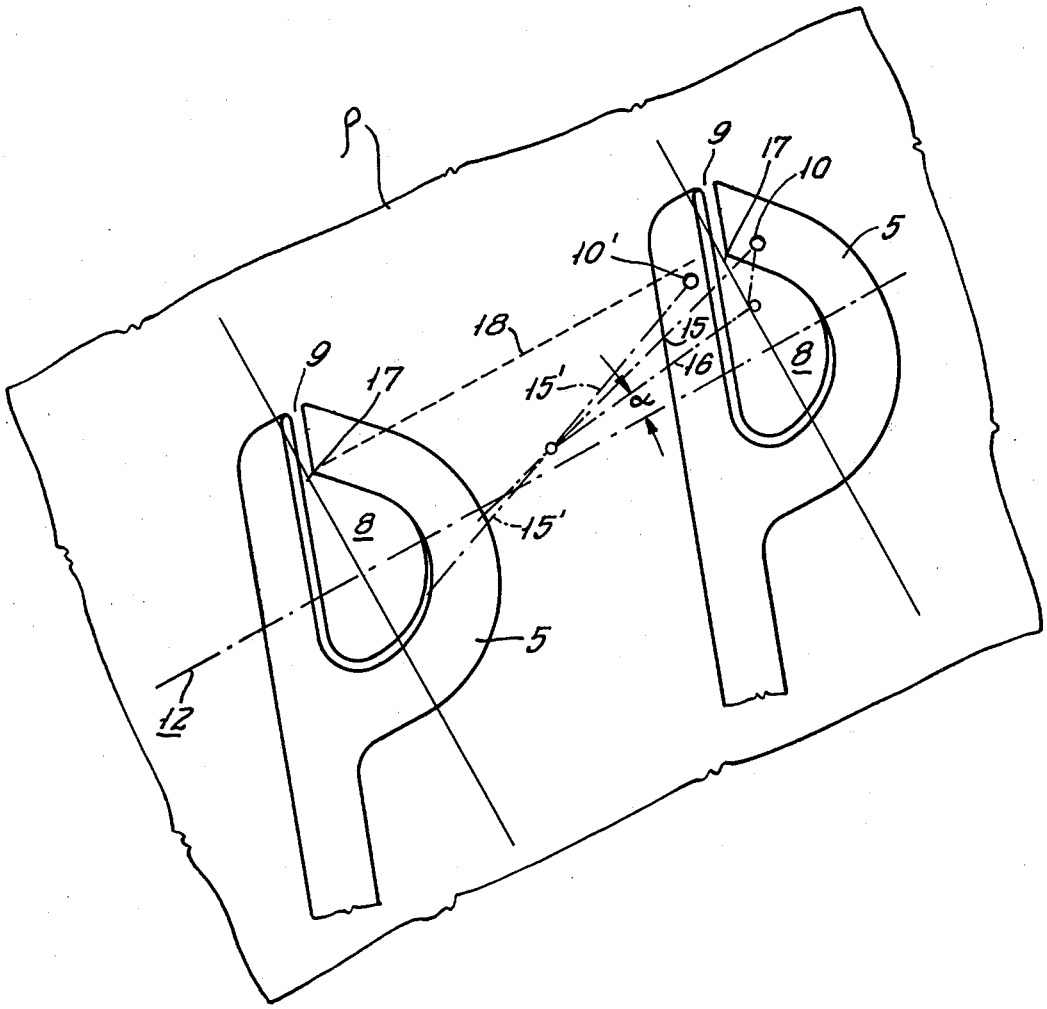
FIG. 8 is a schematic view in perspective showing two comb members, and illustrating how the angle $\alpha$ (to be discussed below), is derived.
Figure 9A:
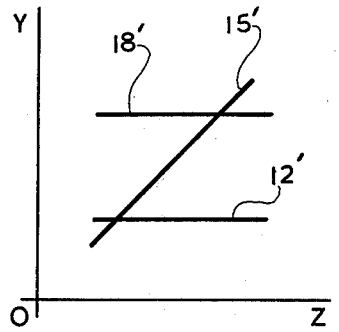
FIG. 9*a* is a view showing the YOZ plane with the axes 12, 15 and 18 projected thereon.
Figure 9B:
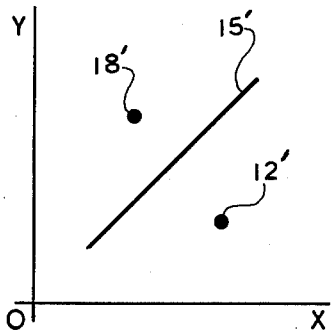
FIG. 9*b* is a view showing the YOX plane with the axes 12, 15 and 18 projected thereon.
Figure 9C:
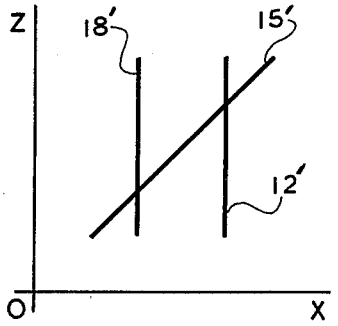
FIG. 9*c* is a view showing the ZOX plane with the axes 12, 15 and 18 projected thereon.
Figure 9D:
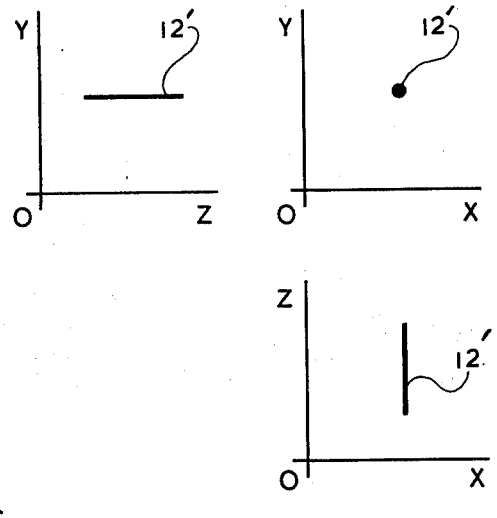
FIG. 9*d* is a three-part composite view showing the projections 12' of the axis 12 of the weft inserting comb upon the respective planes of FIGS. 9*a*, 9*b*, and 9*c*.
Figure 9E:
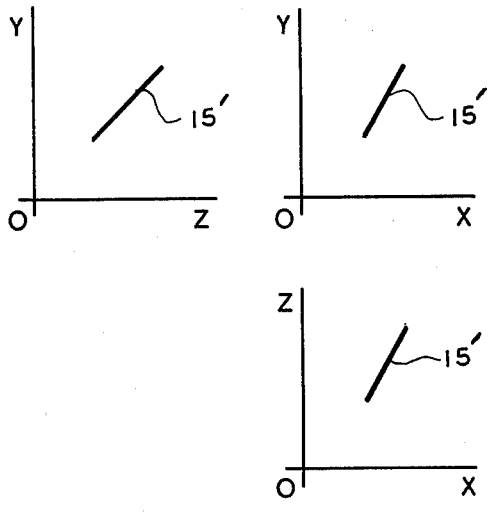
FIG. 9*e* is a three-part composite view showing the projections 15' of the axis 15 of an additive blasting outlet 10 upon the respective planes of FIGS. 9*a*, 9*b*, and 9*c*.

The specified embodiments of the present invention are only described by way of example and many variations within the scope of the present invention are possible. In the exemplary embodiments, all active comb members 5 have substantially the same shape as the passive comb members 4 of the comb 1. This feature is also not absolutely essential for the operation of the device. For example, the active comb members may be U-shaped, as illustrated in FIGS. 6 and 7.

During weft insertion, the weft 14 (see FIG. 2) is propelled in one of the known manners into the weft insertion apertured comb 1, e.g. by a pneumatic nozzle 13, which operates with a primary carrying fluid medium flow. The weft 14 to be inserted moves through the apertured comb members 4 as far as the active comb member 5, and is there accelerated by the secondary carrying medium, which flows from the additive blasting outlet conduits 10, 10' and simultaneously is directed into the zone of weft inserting openings 8 of comb 1, which is situated opposite from the respective unthreading gaps 9.

The secondary flow of the fluid carrying medium thus produces a suitable distribution of the velocity field of the combined fluid carrying medium, particularly in the zone remote from the unthreading gaps 9 of the weft inserting openings 8 of comb members 4, 5 of comb 1. When a loop is formed on the front part of the inserted weft thread 14, the secondary flow of fluid carrying medium opens such a loop and propels the weft thread forwardly.

Usually, the weft insertion apertured comb 1 is provided with a plurality of active comb members 5, and thus the inserted weft thread 14 is propelled from one active comb member 5 to the following one, until the end of weft insertion comb 1 is reached with the aid of the additive fluid flow from the last active comb member 5. In such a case, it is advantageous that the operation of the active comb members 5 is controlled and the effects of the secondary carrying fluid pressure medium are concentrated on the front part of the inserted weft thread 14, which is thus pulled by its front part and passes through the shed 7 in an erected condition. Upon weft insertion through shed 7, the further weaving phases are carried on in the standard known manner. Reed 3 beats up weft thread 14 against the fabric 7A, weft thread 14 is thereafter cut, slay 2 returns to the weft inserting position and the cycle is repeated.

The arrangement and method of the present invention can be applied with particular advantage in jet weaving machines of large weaving widths.

Although the invention is illustrated and described with reference to a plurality of preferred embodiments thereof, it is to be expressly understood that it is in no way limited to the disclosure of such a plurality of preferred embodiments, but is capable of numerous modifications within the scope of the appended claims.

What is claimed is:

1. In a jet loom having a nozzle adapted to direct a stream of a fluid pressure medium through a horizontally disposed weft inserting comb which is cyclically moved by a slay into the shed formed by the warp threads thereby picking a weft thread therethrough, the improvement comprising, a comb made up of a plurality of juxtaposed comb members operatively mounted on the slay, each comb member having a pair of shank portions, the comb members each defining a weft inserting opening and the free ends of said shank portions define an unthreading channel having an inlet opening and communicating the weft inserting opening with the exterior of the comb;

the weft inserting openings through the comb members defining a horizontal picking path for the weft threads, at least one of said plurality of comb members having at least one secondary carrying fluid conduit means having an outlet adjacent to one of the free ends of the shank portions; the axis extending through the weft inserting openings of the plurality of comb members and an imaginary line passing through the midpoints of the inlet openings of the unthreading channels of the comb members define a first plane, a rectangular projection of the axis of said secondary carrying fluid conduit outlet on said first plane forming with the axis extending through the weft inserting openings an angle ranging from 5°–30°, said secondary carrying fluid conduit having an outlet adjacent to each free end of the pair of shank portions, the axes of said pair of outlets mutually intersecting each other at a point located below the weft thread being inserted and below a second plane, relative to the unthreading channel, said second plane being parallel to said axis extending through the weft inserting openings and passes through the central axes of said pair of outlets.

2. In a jet loom having a nozzle adapted to direct a stream of fluid pressure medium through a weft inserting comb which is cyclically moved by a slay into the shed formed by the warp threads thereby picking a weft thread therethrough, the improvement as set forth in claim 1, wherein said secondary carrying fluid conduit has a plurality of outlets of both shank portions being symmetrically disposed relative to each other and form pairs of symmetrically disposed outlets, said second plane passing through the centers of the pair of outlets most distant from said unthreading channel.

3. In a jet loom having a nozzle adapted to direct a stream of fluid pressure medium through a weft inserting comb which is cyclically moved by a slay into the shed formed by the warp threads thereby picking weft thread therethrough, the improvement as set forth in claim 2, wherein the axes of all of said pairs of outlets intersect each other in said first plane.

4. In an apparatus for picking a weft thread through a weft inserting comb in a jet loom by means of a stream of a fluid pressure medium, flowing forwardly from a nozzle through a horizontally disposed comb, wherein said comb is cyclically moved into the shed formed by the warp threads, the improvement wherein said comb includes a plurality of juxtaposed apertured comb members defining a horizontal picking path for the weft thread, each comb member having a pair of shank portions which define an unthreading channel therebetween, at least one comb member having secondary carrying fluid outlet means in each shank portion, said outlet means having axes mutually intersecting at a point below the picking path of the weft thread for respectively directing downwardly and forwardly beneath the weft thread at the leading portion of the weft thread passing through each of the openings of the comb members a stream of a secondary carrying fluid in a zone of the openings of the comb members which is spaced from and disposed opposite from said unthreading channels and which is substantially equidistant from said fluid outlet means in each shank portion.

5. A method of picking a weft thread through a weft inserting comb in a jet loom by means of a stream of a fluid pressure medium, flowing forwardly from a nozzle through a horizontally disposed comb, wherein said comb is cyclically moved into the shed formed by the warp threads, and wherein said comb includes a plurality of juxtaposed apertured comb members defining a horizontal picking path for the weft thread, each comb member having a pair of shank portions which define an unthreading channel therebetween, at least one comb member having secondary carrying fluid outlet means in each shank portion, the improvement comprising the step of directing downwardly and forwardly along paths which intersect beneath the path of the weft thread streams of a secondary carrying fluid via said outlet means in a zone of the openings of the comb members which is spaced from and disposed opposite from said unthreading channels and which is substantially equidistant from said fluid outlet means in each shank portion so as to contact the leading portion of the weft thread passing through each of the openings of the comb members.

6. In a jet loom having a nozzle adapted to direct a stream of a fluid pressure medium through a horizontally disposed weft inserting comb which is cyclically moved by a slay into the shed formed by the warp threads thereby picking a weft through therethrough, the improvement comprising, a comb made up of a plurality of juxtaposed comb members operatively mounted on the slay, each comb member having a pair of shank portions, the comb members each defining a weft inserting opening and the free ends of said shank portions define an unthreading channel having an inlet opening and communicating the weft inserting opening with the exterior of the comb;

the weft inserting opening through the comb members defining a horizontal picking path for the weft threads, at least one of said plurality of comb members having at least one secondary carrying fluid conduit means having an outlet adjacent to one of the free ends of the shank portions; the axis extending through the weft inserting openings of the plurality of comb members and an imaginary line passing through the midpoints of the inlet openings of the unthreading channels of the comb members define a first plane, a rectangular projection of the axis of said secondary carrying fluid conduit outlet on said first plane forming with the axis extending through the weft inserting openings an angle ranging from 5°-30°, wherein streams of secondary carrying fluid issue from the openings in the shank portions of said one comb member, and said streams of secondary carrying fluid intersect at a location beneath the weft thread travelling through the comb.

* * * * *